US006236379B1

(12) United States Patent
Yokoyama et al.

(10) Patent No.: US 6,236,379 B1
(45) Date of Patent: May 22, 2001

(54) ACTIVE MATRIX PANEL AND DISPLAY DEVICE

(75) Inventors: Ryoichi Yokoyama, Ohgaki; Mitsugu Kobayashi, Nagoya, both of (JP)

(73) Assignee: Sanyo Electric Co., Ltd., Osaka (JP)

( * ) Notice: Subject to any disclaimer, the term of this patent is extended or adjusted under 35 U.S.C. 154(b) by 0 days.

(21) Appl. No.: 09/160,981

(22) Filed: Sep. 25, 1998

(30) Foreign Application Priority Data

Sep. 30, 1997 (JP) ..... 9-266712

(51) Int. Cl.[7] ..... G09G 3/20
(52) U.S. Cl. ..... 345/55
(58) Field of Search ..... 345/55, 87, 88, 345/90, 92

(56) References Cited

U.S. PATENT DOCUMENTS 5,070,409 * 12/1991 Miyadera et al. ..... 358/241
5,712,652 * 1/1998 Sato et al. ..... 345/55
5,724,061 * 3/1998 Kanbara ..... 345/55
5,764,207 * 6/1998 Maekawa et al. ..... 345/99
5,963,187 * 10/1999 Tanaka et al. ..... 345/97

* cited by examiner

*Primary Examiner*—Richard A. Hjerpe
*Assistant Examiner*—Ronald Laneau
(74) *Attorney, Agent, or Firm*—Hogan & Hartson, LLP.

(57) ABSTRACT

Two series of color video signal lines (1R, 1G, and 1B) (2R, 2G, and 2B) for receiving in a panel two series of input color video signals from outside the panel, a plurality of switching elements (11, 12, 13 . . . ) for connecting each of the two series of color video signal lines to each data line, and a drive pulse generating circuit which sequentially generates drive pulses (PC1, PC2, PC3 . . . ) for controlling open and close of the plurality of switching elements are provided. Odd-numbered drive pulses are applied to switching elements corresponding to a first series of color video signals, and even-numbered drive pulses are applied to switching elements corresponding to a second series of color video signals. For example, when used as a panel for displaying analog video signals, it is sufficient to supply output from a single series of sample hold circuit provided outside the panel to two series of color video signal lines and, when used as a panel for graphics display, it is sufficient to supply output from a sample hold circuit for two series of color video signals to two series of color video signal lines. Therefore, it is possible to provide an active matrix panel for displaying both analog video and CG characters.

18 Claims, 7 Drawing Sheets

ACTIVE MATRIX PANEL AND DISPLAY DEVICE

BACKGROUND OF THE INVENTION

1. Field of the Invention

The present invention relates to an active matrix panel with a built-in data line drive circuit and to a display device using the panel.

2. Description of the Related Art

On an active matrix panel in which a polycrystal silicon is used for a channel of a thin film transistor (hereinafter referred to as TFT), pixel electrodes and TFTs for picture element which are provided correspondingly to the electrodes are arranged in the form of matrix, and a plurality of data lines and scanning lines are arranged according to the TFTs also in the form of matrix. A built-in drive circuit for supplying data signals and scanning signals to the data lines and the scanning lines is provided in the same active matrix panel on which the pixel TFTs are formed.

Examples of such built-in type conventional data line drive circuits are shown in FIGS. 1 and 2. In a data line drive circuit 1 as shown in FIG. 1, a series of RGB color video signals are input to the circuit which is composed of three color video signal lines 1R, 1G, and 1B for leading a series of RGB color video signals in a panel; switching elements 11, 21, 31 . . . for connecting data lines D1, D4, D7 . . . to the color video signal line 1R; switching elements 12, 22, 32 . . . for connecting data lines D2, D5, D8 . . . to the color video signal line 1G; switching elements 13, 23, 33 . . . for connecting data lines D3, D6, D9 . . . to the color video signal line 1B; and a drive pulse generating circuit comprising a shift register 4 for sequentially generating drive pulses PA1, PA2, PA3 . . . in response to clock signals CLKS. The drive pulse PA1 at the first stage of the shift register 4 is applied to the switching elements 11, 12, and 13, then the drive pulse PA2 at the next stage is applied to the switching elements 21, 22, and 23, and subsequently same processes are repeated, in other words, the respective identical drive pulses are applied to each three switching elements corresponding to the BRG color video signals.

At the exterior of the panel, as shown in FIG. 3, are provided a sample hold circuit 100 for a series of RGB color video signals which sequentially performs sampling of each RGB color video signal and simultaneously output hold signals for a prescribed period, and an inversion amplifier 200 which amplifies each of the RGB signals having gone through sample hold and outputs the signal after inverting it at every horizontal period and vertical period. It is arranged so that three outputs of the inversion amplifier 200 are input to the three color video signal lines 1R, 1G, and 1B in the panel.

Thus, when the drive pulse PA1 becomes high level, the switching elements 11, 12, and 13, which correspond to a series of RGB signals equivalent to three dots, are simultaneously turned on. Then, video signals input to the three color video signal lines 1R, 1G, and 1B are simultaneously supplied to the data lines D1, D2, and D3. Similarly, when the drive pulses PA2, PA3 . . . Sequentially become high level, respective RGB video signals equivalent to three dots are simultaneously supplied to the data lines.

Here, the video signal lines 1R, 1G, and 1B have various parasitic capacities and line resistance, whereby video signals are delayed. In a circuit of a three dot corresponding system as shown in FIG. 3, new video signals are input to each of the video signal lines at intervals of three dots from an external sample hold circuit. Thus, for example, when a video signal three dots before is black level and a video signal three dots after is white level, when a delay of the video signal is great, a part of the black level is mixed with the white level three dots later, whereby a ghost of intermediate level may arise.

Such a ghost is negligible in displaying ordinary analog video signals for television or the like, but is very conspicuous when the display is used for displaying graphics. Thus, a circuit shown in FIG. 2 is occasionally used to prevent such ghosts from appearing.

A data line drive circuit 2 for inputting two series of RGB color video signals as shown in FIG. 2 is composed of six color video signal lines 1R, 1G, 1B, 2R, 2G, and 2B for leading two series of RGB color video signals in the panel; switching elements 11, 31 . . . for connecting data lines D1, D7 . . . to the color video signal line 1R; switching elements 12, 32 . . . for connecting data lines D2, D8 . . . to the color video signal line 1G; switching elements 13, 33 . . . for connecting data lines D3, D9 . . . to the color video signal line 1B; switching elements 21, 41 . . . for connecting data lines D4, D10 . . . to the color video signal line 2R; switching elements 22, 42 . . . for connecting data lines D5, D11 . . . to the color video signal line 2G; switching elements 23, 43 . . . for connecting data lines D6, D12 . . . to the color video signal line 2B; and a drive pulse generating circuit comprising a shift register 5 for sequentially generating drive pulses PB1, PB2, PB3 . . . in response to clock signals CLKs. The drive pulse PB1 at the first stage of the shift register 5 is applied to the switching elements 11, 12, 13, 21, 22, and 23, then the drive pulse PB2 at the next stage is applied to the switching elements 31, 32, 33, 41, 42, and 43, and subsequently same processes are repeated, in other words, the respective identical drive pulses are applied to each six switching elements corresponding to two series of RGB color video signals.

When graphics are displayed, a video signal to be input is typically an 8-bit-per-dot digital signal. At the exterior of the panel, there are provided a sample hold circuit 300 for two series of RGB signals which sequentially perform sampling of each series of RGB color video signals and simultaneously output hold signals equivalent to six dots for a prescribed period, a D/A converter 400 for converting digital signals equivalent to six dots supplied from the sample hold circuit 300 into analog signals, and an inversion amplifier 500 which amplifies the converted analog signals equivalent to six dots and outputs the signals after inverting them at every horizontal period and vertical period. It is arranged so that six outputs of the amplifier 500 are input to the six color video signal lines 1R, 1G, 1B, 2R, 2G, and 2B in the panel.

Thus, when the drive pulse PB1 becomes high level, the switching elements 11, 12, 13, 21, 22, and 23 which correspond to two series of RGB color video signals equivalent to six dots are simultaneously turned on, and video signals input to the six color video signal lines 1R, 1G, 1B, 2R, 2G, and 2B are then supplied simultaneously to the data lines D1, D2, D3, D4, D5, and D6. Similarly, when the drive pulses PA2, PB3 . . . sequentially become high level, respective RGB video signals equivalent to six dots are simultaneously supplied to the data lines.

With this constitution, new video signals are input to each of the video signal lines from an external sample hold circuit at intervals of six dots. Thus, even when a video signal six dots before is black level, a video signal six dots later is white level, and a delay of video signals is great, a part of the black level will not mix with the white level and ghost images can be prevented. Thus, such constitution of six dots corresponding system is optimum when graphic images are displayed.

As described above, a conventional three dots system circuit such as is shown in FIG. 1 is not sufficient for displaying graphics because such ghosts will arise. However, ghosts can be ignored when ordinary analog video signals are displayed and in such a system it is sufficient to have a series of external sample hold circuit. Thus, conventional circuit have advantages in terms of cost. On the other hand, a circuit of six dots system shown in FIG. 2 can prevent ghosts and is therefore suitable for displaying graphics. However, because a plurality of series of external sample hold circuits are required, this system makes it costly to display ordinary analog video signals. Thus, it is optimum that a circuit such as shown in FIG. 1 be used to display ordinary analog video signals and a circuit such as shown in FIG. 2 be used for graphic applications.

However, the circuits shown in FIGS. 1 and 2 differ not only in the constitution of the respective external sample hold circuit, but also in the constitution of the respective built-in data line drive circuits of the panels. Thus, different panels must be used to display ordinary analog video signals or graphics. In other words, two designs are required for the panels, and design and production costs are increased when two types of panels must be manufactured.

SUMMARY OF THE INVENTION

The present invention is directed to providing an active matrix panel which can be used for displaying both ordinary analog video signals and graphics by enabling the active matrix panel to apply to, for example, both a three dots corresponding system and a six dots corresponding system.

The present invention can be in the form of an active matrix panel, wherein on its substrate, there are provided pixel electrodes and thin film transistors arranged in the form of matrix; data lines and scanning lines which are connected with the thin film transistors; and a data line drive circuit for supplying video signals to the data lines. This data line drive circuit comprises: a plurality of series of color video signal lines for receiving in the active matrix panel a plurality of input color video signal series; a plurality of switching elements for connecting the plurality of color video signal lines to corresponding data lines; and a drive pulse generating circuit for generating drive pulses for controlling the opening and closing of the plurality of switching elements at a respective predetermined timings, wherein different drive pulses are applied to the switching elements at every series classified corresponding to the series of the color video signals.

Further, in another aspect of the present invention, a display device comprises: an active matrix panel as described above; a single series of sample hold circuit for sampling and holding external color video signals; and an output line for branching outputs of the single series of sample hold circuit into a plurality of series and transmitting them, wherein signals to be transmitted to the output line are supplied at every series as the plurality of series of color video signals to the plurality of series of color video signal lines of the active matrix panel.

Further, in another aspect of the present invention, a display device comprises: an active matrix panel as described above; and a sample hold circuit for sampling and holding a plurality of series of external color video signals and outputting hold signals at every series at different timing, wherein output of the sample hold circuit is supplied to corresponding series among the plurality of series of color video signal lines of the active matrix panel.

As described above, according to the present invention, the same active matrix panel can be used for both display of ordinary analog video (for example, display for television) and display of computer graphics (CG) or character display, whereby design waste can be reduced or eliminated. Further, by providing a plurality of series of shift registers which generate drive pulses, the operating frequency can be lowered.

DESCRIPTION OF THE PREFERRED EMBODIMENTS

Figure 1:
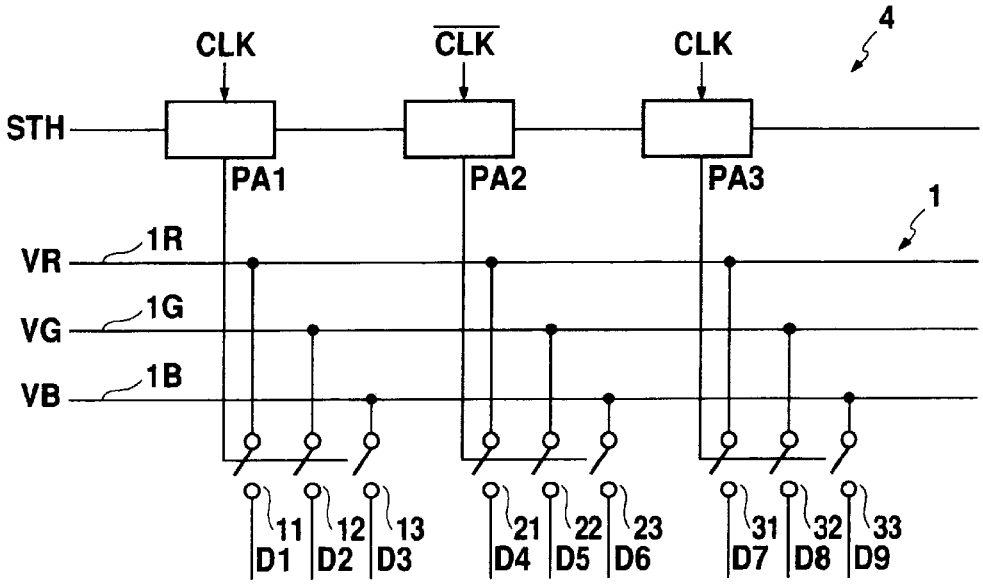
Fig. 1 PRIOR ART
FIG. 1 is a circuit diagram showing an example of conventional panels for displaying analog video.
Figure 2:
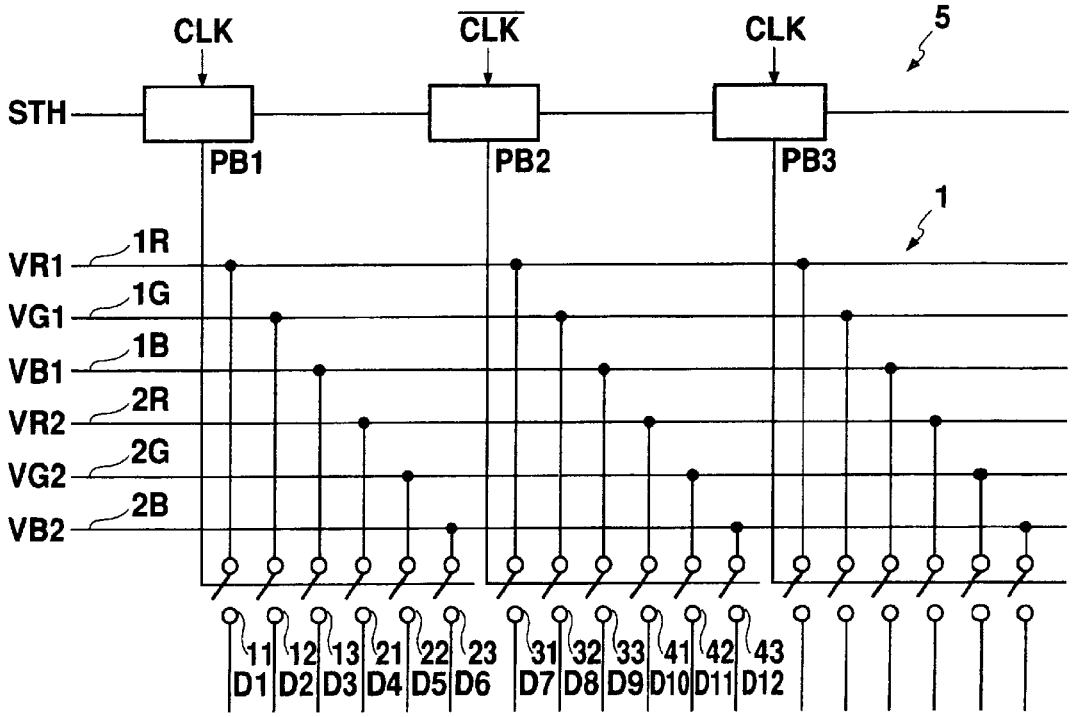
Fig. 2 PRIOR ART
FIG. 2 is a circuit diagram showing an example of conventional panels for displaying graphics.
Figure 3:
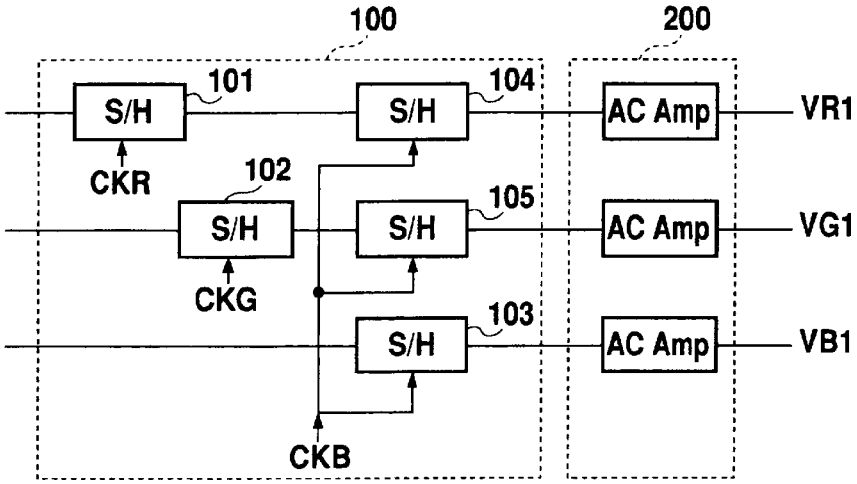
Fig. 3 PRIOR ART
FIG. 3 is a circuit diagram showing an external circuit to be connected to the circuit shown in FIG. 1 in a display device.
Figure 4:
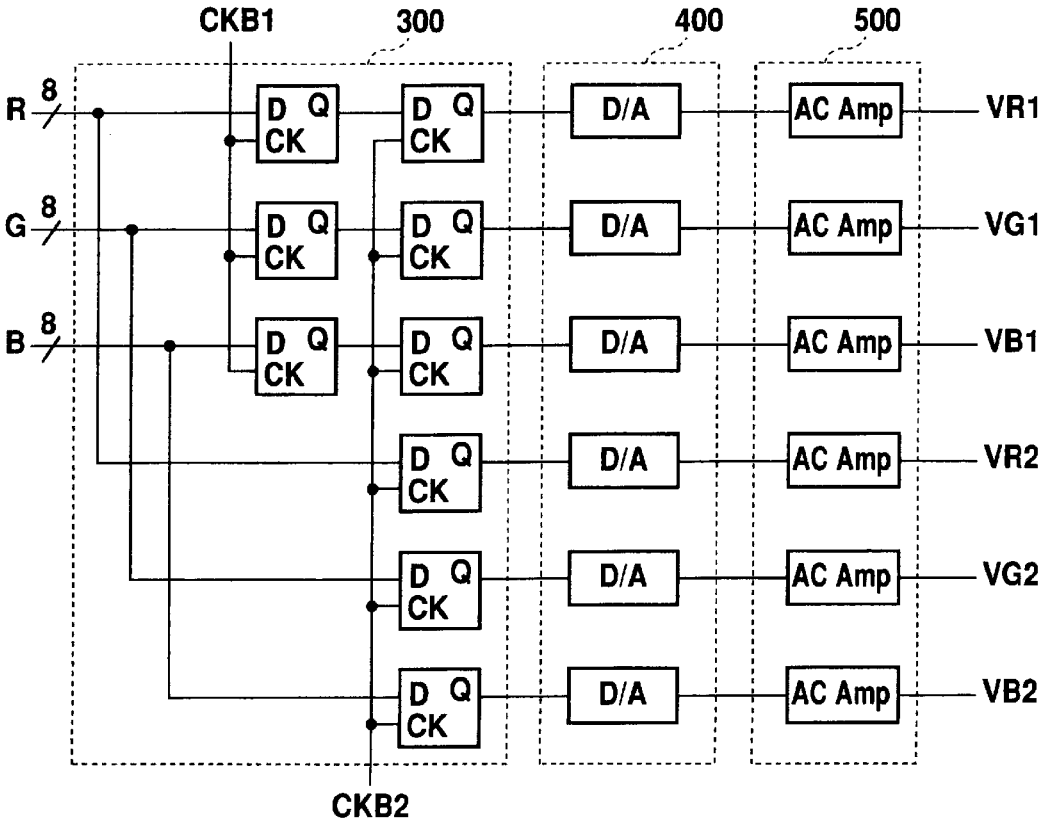
Fig. 4 PRIOR ART
FIG. 4 is a circuit diagram showing an external circuit to be connected to the circuit shown in FIG. 2 in a display device.
Figure 5:
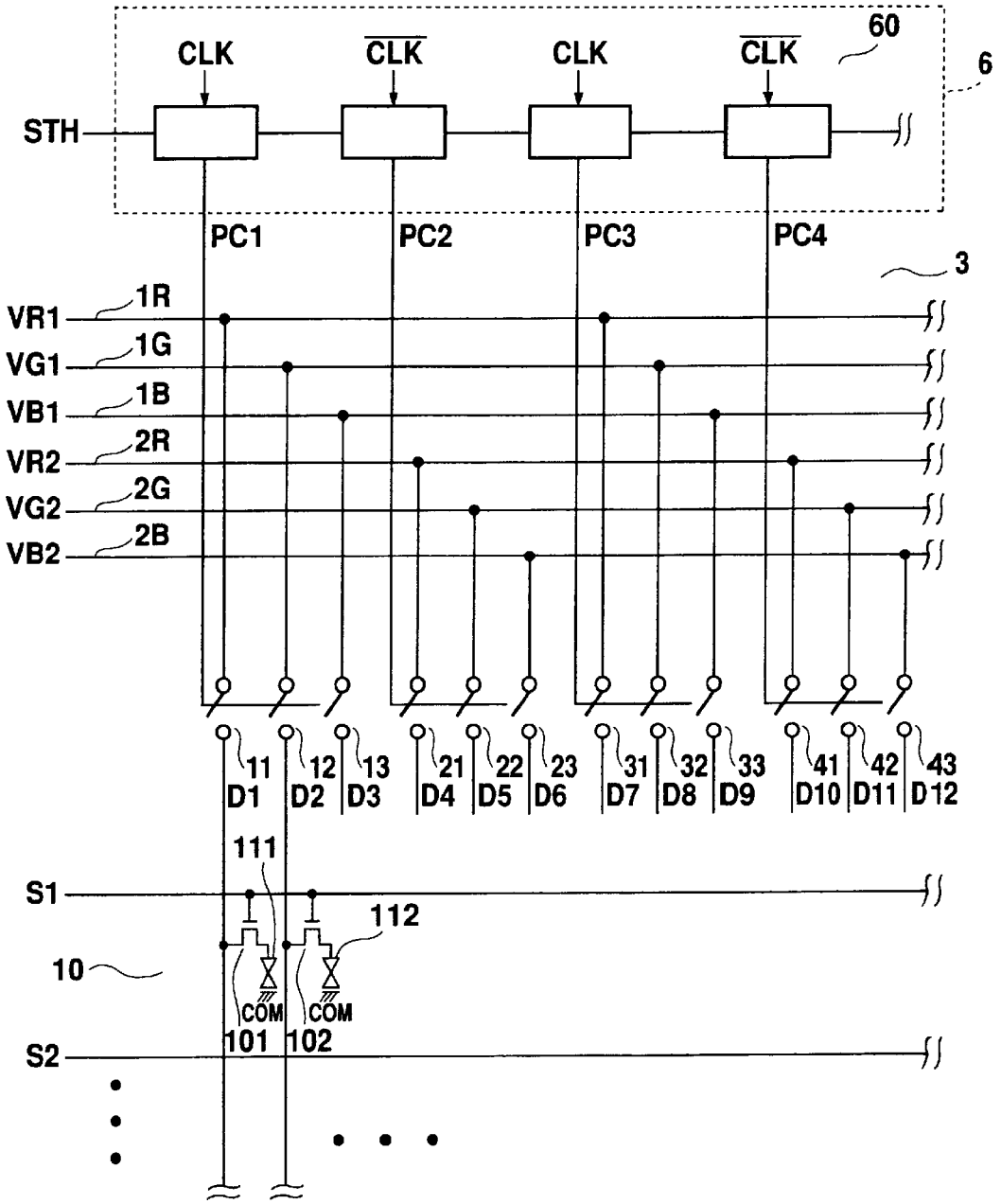
FIG. 5 is a circuit diagram showing a part of an active matrix panel according to an embodiment of the present invention.

FIG. 5 is a circuit diagram showing an active matrix panel according to a first embodiment of the present invention. In FIG. 5, numeral 10 indicates a display area where a plurality of scanning lines S1, S2 . . . and a plurality of data lines D1, D2 . . . are arranged in such a manner that they are perpendicular to each other, and near the points of intersection, TFTs 101, 102 . . . are formed. A gate electrode of the respective TFTs is connected to the respective scanning lines (S1 . . . Sn) and a drain electrode is connected to the respective data lines (D1 . . . Dn). On the other hand, each source electrode of the TFTs 101, 102 . . . is connected to respective pixel electrodes 111, 112 . . . which are arranged in the form of matrix, and liquid crystal is sealed in between the pixel electrodes and common electrodes (COMs) which are arranged facing to each other.

In this panel, a scanning line drive circuit and a data line drive circuit 3 are built in together with the display area, and scanning line signals are supplied to the scanning lines S1, S2 . . . from the scanning line drive circuit which is not shown in the drawings.

Further, the data line drive circuit 3 is comprised six color video signal lines 1R, 1G, 1B, 2R, 2G, and 2B for receiving two series of RGB color video signals in the panel; switching elements 11, 31 . . . for connecting the data lines D1, D7 . . . to the color video signal line 1R; switching elements 12, 32 . . . for connecting the data lines D2, D8 . . . to the color video signal line 1G; switching elements 13, 33 . . . for connecting the data lines D3, D9 . . . to the color video signal line 1B; switching elements 21, 41 . . . for connecting the data lines D4, D10 . . . to the color video signal line 2R; switching elements 22, 42 . . . for connecting the data lines D5, D11 . . . to the color video signal line 2G; switching elements 23, 43 . . . for connecting the data lines D6, D12 . . . to the color video signal line 2B; and a drive pulse generating circuit 6 comprising a series of shift register 60 for sequentially generating drive pulses PC1, PC2, PC3 . . . in response to clock signals CLKs. Drive pulse PC1 at the first stage of the shift register 60 is applied to the switching elements 11, 12, and 13, drive pulse PC2 at the next stage is applied to the switching elements 21, 22, and 23, and the same processes are subsequently repeated. In other words, the respective drive pulses at different stages of the shift register are applied to each three switching elements.

More specifically, the drive pulses PC1, PC3 . . . at odd stages of the shift register 60 are applied to each three switching elements of the same series which are connected to the first series of video signal lines 1R, 1G, and 1B. The drive pulses PC2, PC4 . . . at even stages of the shift register 60 are applied to each three switching elements of the same series different from the above-mentioned series which are connected to the second series of video signal lines 2R, 2G, and 2B.

Here, the shift register 60 is constituted such that a latch circuit which operates in response to a rise of clock signal CLK and a latch circuit which operates in response to a fall of clock signal CLK are alternately connected. A start signal STH which becomes high level for about one cycle of the clock signal CLK is input to an input terminal at the first stage. The clock signal CLK is used for determining timing of writing each signal corresponding to a pixel into crystal liquid, synchronizes with a dot clock, and its cycle is set to be six times that of the dot clock.

First, a case of applying the panel to the three dots corresponding system will be described.

Figure 9:
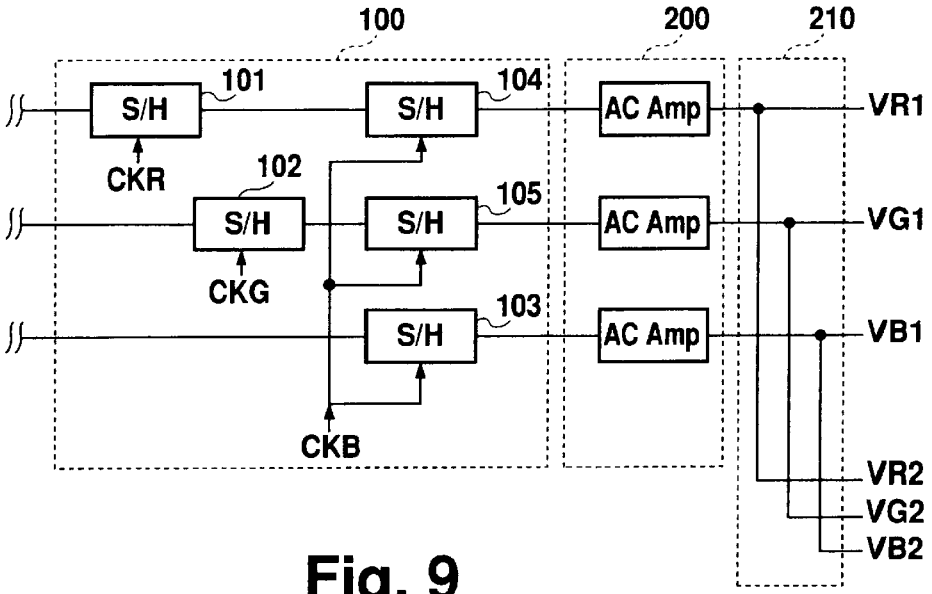
FIG. 9 is a circuit diagram showing an external circuit of a panel in a display device according to one embodiment of the present invention.

In this case, as shown in FIG. 9, at the exterior of the panel, there are provided the sample hold circuit 100 for a series of RGB color video signals for sequentially sampling each RGB color video signal and simultaneously outputting hold signals for a prescribed period, and the inversion amplifier 200 for amplifying each RGB signal which has under gone sample hold, and outputting the signals after inverting them at every horizontal and vertical period. There is also provided an external color video signal line 210 for branching a series of three outputs from the inversion amplifier 200 into two series of six outputs and leading them out to the panel. It is arranged so that six outputs from the external color video signal line 210 are input to the six color video signal lines IR, 1G, 1B, 2R, 2G, and 2B in the panel.

Figure 6:
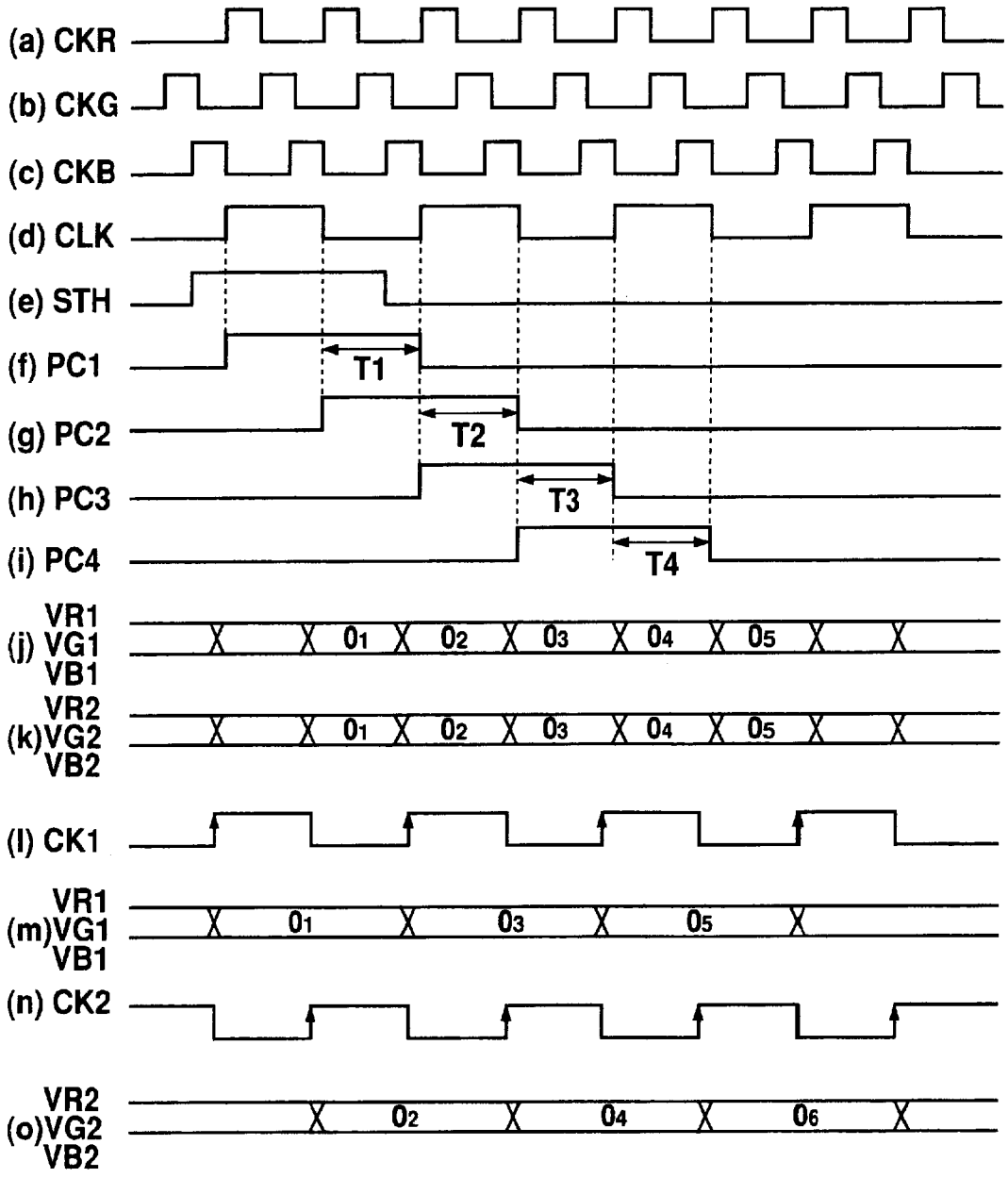
FIG. 6 is a timing chart describing operation of circuit in a display device according to the embodiment of the present invention.

In the sample hold circuit 100, the sample hold circuits 101, 102, 103 perform sample hold of the respective analog color signals R, G, and B to be input at a timing which is successively delayed by one third of the cycle of clock signal CLK in response to sampling clocks CKR, CKG, and CKB which are shown by waveforms (a), (b), and (c) in FIG. 6. Further, sample hold circuits 104 and 105 further perform sample hold of output of the sample hold circuits 101 and 102 at the same timing as that of the sample hold circuit 103 in response to the sampling clock CKB which is shown by waveform (c).

Thus, RGB video signals equivalent to three dots VR1, VG1, and VB1 which constitute one pixel are simultaneously input to the first series of color video signal lines 1R, 1B, and 1G in the panel, as shown by a waveform (j) in FIG. 6. These video signals are held for a half cycle of the clock signal CLK, and afterward new video signals are input every half cycle. Further, since the external video signal line 210 merely branches the same video signal, as shown by a waveform (k) in FIG. 6, video signals VR2, VG2, and VB2 identical to the video signals VR1, VG1, and VB1 are input to the second series of color video signal lines 2R, 2B, and 2G in the panel, too.

On the other hand, when a start signal STH as shown by waveform (e) in FIG. 6 is input to the shift register 60, a drive pulse PC1 from the first stage becomes high level in response to a rise of the clock signal CLK as shown by waveform (f) in FIG. 6 and the high level is maintained for a cycle of the clock signal CLK. Further, in response to a fall of the clock signal CLK, a drive pulse PC2 from the next stage becomes high level as shown by a waveform (g) in FIG. 6, and the high level is maintained for a cycle of the clock signal CLK. The same processes are repeated, or, in other words, respective drive pulses PC3, PC4 . . . which become high level for a cycle are sequentially output at every half cycle of the clock signal CLK, as shown by waveforms (h) and (i) in FIG. 6. As described above, among these drive pulses, drive pulses from odd stages PC1, PC3 . . . are applied to each three switching elements which are connected to the first series of video signal lines 1R, 1G, and 1B, and drive pulses from even stages PC2, PC4 . . . are applied to each three switching elements which are connected to the second series of video signal lines 2R, 2G, and 2B.

Therefore, during a period T1 of the drive pulse PC1 being high level, three switching elements 11, 12, and 13 are turned on and three dots video signals O1 from the first series of video signal lines 1R, 1G, and 1B are supplied to the data lines D1, D2, and D3. And, during the next period T2 of the drive pulse PC2 of being high level, three switching elements 21, 22, and 23 are turned on and three dot video signals O2 from the second series of video signal lines 2R, 2G, and 2B are supplied to the data lines D4, D5, and D6. Similarly, when drive pulses PC3, PC4 . . . sequentially become high level, the first and second series of each three dots video signals are alternately supplied to the respective corresponding data lines. Here, although two series of video signal lines are provided in the panel, video signals for the same dot are input to the first and second series of signal lines (VR1=VR2, VG1=VG2, and VB1=VB2), and therefore new video signals are inputted to each video signal line at every three dots. In other words, driving by the three dots corresponding system is realized.

Next, a case which the panel is applied to a six dots corresponding system will be described.

Here, when, for example, for the purpose of displaying computer graphics, video signals to be input are 8-bit-per-dot digital signals and three dots RGB video signals corresponding to one pixel are simultaneously supplied.

Figure 10:
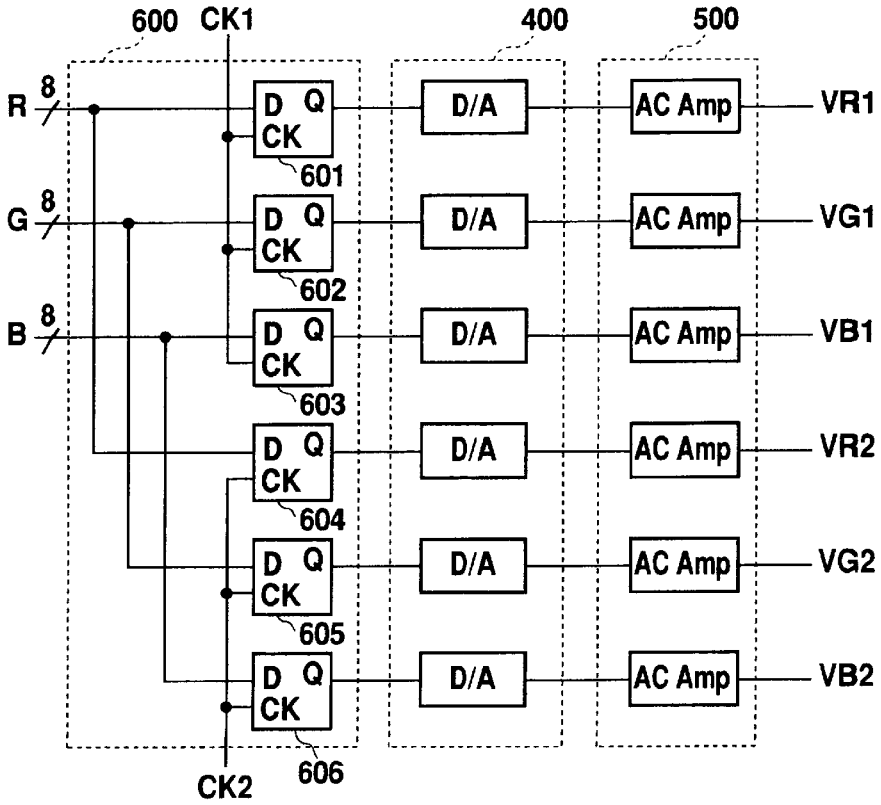
FIG. 10 is a circuit diagram showing an external circuit of the panel in the display device according to another embodiment of the present invention.

In this case, as shown in FIG. 10, at the exterior of the panel are provided a sample hold circuit 600 for two series of RGB color video signals for sequentially sampling each series of RGB color video signals and outputting hold signals equivalent to three dots at different timing, a D/A converter 400 for converting digital signals equivalent to six dots from the sample hold circuit 600 into analog signals, and an inversion amplifier 500 for amplifying the converted analog signals equivalent to six dots and outputting the signals after inverting them at every horizontal period and vertical period. It is arranged so that six outputs of the amplifier 500 are input to six color video signal lines 1R, 1G, 1B, 2R, 2G, and 2B in the panel.

The sample hold circuit 600 comprises D flip flops 601, 602, and 603 equivalent to three dots for sample hold input digital video signals in response to a sample clock CK1 and D flip flops 604, 605, and 606 equivalent to three dots for sample hold input digital video signals in response to a sample clock CK2. Further, as shown by waveforms (1) and (n) in FIG. 6, the sample clock CK1 is identical to the clock signal CLK shown by the waveform (d) and the sample clock CK2 is an inverted clock signal CLK. Thus, as shown by a waveform (m), three dots RGB video signals VR1, VG1, and VB1 which constitute one pixel are simultaneously input to the first series of color video signal lines 1R, 1B, and 1G in the panel in response to a rise of the sample clock CK1. These video signals are held for a cycle of the clock signal CLK and then new video signals are input at every cycle. Further, as shown by a waveform (o) in FIG. 6, three dots RGB video signals VR2, VG2, and VB2 which constitute one pixel are simultaneously input to the second series of color video signal lines 2R, 2B, and 2G, in the panel in response to arise of the sample clock CK2. These signals are held for a cycle of the clock signal CLK, and then new video signals are input at every cycle.

Therefore, during the period T1 of the drive pulse PC1 being high level, three switching elements 11, 12, and 13 are turned on, and three dots video signals O1 from the first series of video signal lines 1R, 1G, and 1B are supplied to the respective corresponding data lines D1, D2, and D3. During the next period T2 of the PC2 being high level, three switching elements 21, 22, and 23 are turned on, and three dots video signals O2 from the second series of video signal lines 2R, 2G, and 2B are supplied to the respective corresponding data lines D4, D5, and D6. Similarly, when drive pulses PC3, PC4 . . . sequentially become high level, the first and second series of video signals equivalent to three dots are alternately supplied to the respective corresponding data lines.

Here, since the sample hold circuit 600 performs sampling at different timing at intervals of one pixel (RGB signals equivalent to three dots), unlike the circuit shown in FIG. 9, video signals corresponding to different pixels are input to the first and second series of video signal lines in the panel. Therefore, new video signals are input to each of the video signal lines only at every six dots. In other words, driving by the six pixel corresponding system can be realized and this system enables optimum graphics display.

With respect to the constitution of a circuit shown in FIG. 5, since the drive pulse generating circuit 6 is comprised one series of shift register 60, it is necessary to operate the shift register 60 using high speed clock signals CLKS. If it is difficult to do so, the drive pulse generating circuit 6 may be composed of a plurality of series of shift registers.

Figure 7:
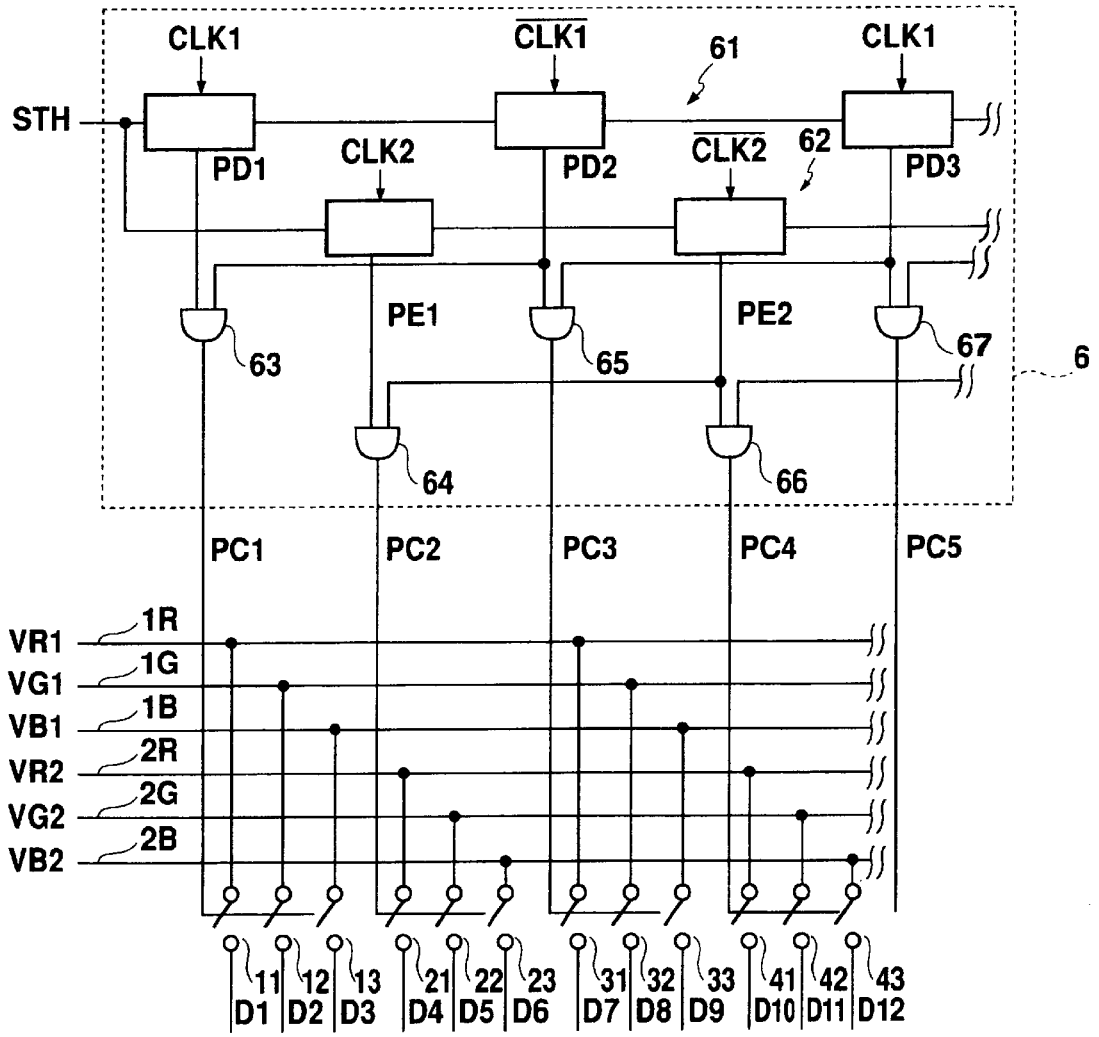
FIG. 7 is a circuit diagram showing the main portion of an active matrix panel according to another embodiment of the present invention.

FIG. 7 shows an example drive pulse generating circuit 6 comprises two series of shift registers 61 and 62. In this example, the constitution of the respective shift registers is nearly identical to that of the shift register 60, and the frequency of clock signals CK1, CK2 and the start signal STH to be applied is half as much as that of the signals to be applied the shift register 60. Further, AND gates 63, 65 . . . which calculate logical product of an output are provided at a certain stage and an output at the next stage of the shift register 61, and these outputs are intended to be drive pulses PC1, PC3 . . . for the switching elements connected to the first series of video signal lines 1R, 1G, and 1B. Similarly, AND gates 64 and 66 . . . which calculate product of an output are provided at a certain stage and an output are provided at the next stage of the shift register 62, and these outputs are intended to be drive pulses PC2, PC4 . . . for the switching elements connected to the second series of video signal lines 2R, 2G, and 2B.

With the constitution described above, as shown by the waveform (d) in FIG. 8, from each stage of the first series of shift register 61, outputs PD1, PD2, PD3 . . . whose pulse width is equivalent to one cycle of the clock signal CK1, namely, two cycles of the clock signal CLK are sequentially output synchronizing with a rise of the clock signal CLK. Further, as shown by waveforms (h) to (j) in FIG. 8, from each stage of the second series of shift register, outputs PE1, PE2, PE3 . . . whose pulse width is equivalent to one cycle of the clock signal CK2, namely, two cycles of the clock signal CLK are sequentially output synchronizing with a fall of the clock signal CLK.

Figure 8:
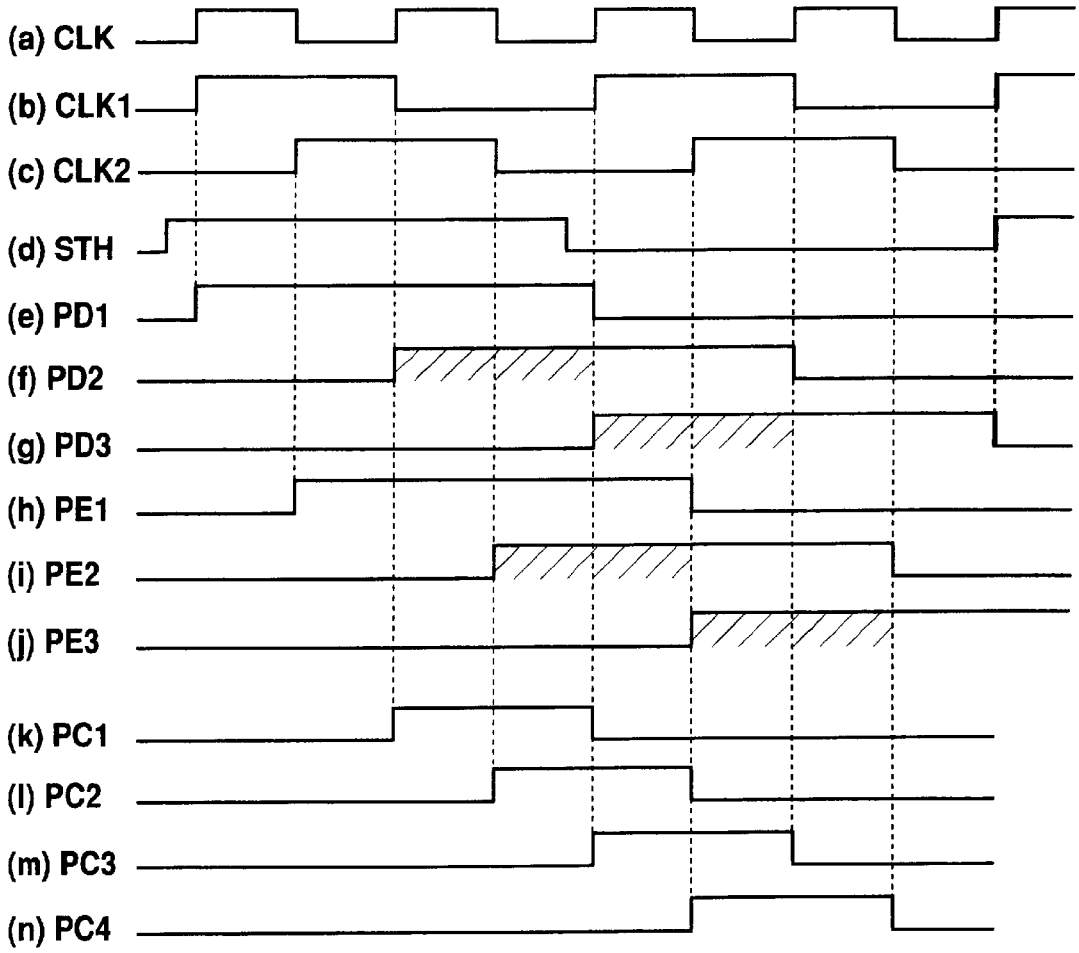
FIG. 8 is a timing chart describing operation of circuit in the panel shown in FIG. 7.

Thus, as shown by waveforms (k), (l), (m), and (n) in FIG. 8, from the AND gates 62, 63, 64 . . . , drive pulses PC1, PC2, PC3 . . . which are identical to those shown by waveforms (f), (g), (h), and (i) in FIG. 6 are output. In other words, the drive pulse generating circuit which is composed of two series of shift registers 61 and 62 shown in FIG. 7 only requires a half operating frequency and performs the same operation as that of a series of shift register 60 shown in FIG. 5.

Although a circuit having two series of video signal lines has been described above, it may also be preferable to have three or more series of video signal lines.

What is claimed is:

1. An active matrix panel, said panel comprising, on a substrate:

pixel electrodes and thin film transistors arranged in the form of matrix;

data lines and scanning lines connected with said thin film transistors; and a data line drive circuit for supplying video signals to the data lines, said data line drive circuit comprising:

a plurality of series of color video signal lines for receiving in said panel a plurality of series of input color video signals;

a plurality of switching elements for connecting said plurality of series of color video signal lines to corresponding data lines; and a drive pulse generating circuit which generates drive pulses for controlling opening and closing of said plurality of switching elements at respective predetermined timings, wherein said drive pulses are applied series-by-series on the series of said color video signals so that the opening and closing of a plurality of switching elements belonging to the same series of said color video signals are controlled at the same timing and the opening and closing of a plurality of switching elements belonging to different series of said color video signals are controlled at a different timing.

2. The active matrix panel according to claim 1, wherein said color video signal lines have integral number n series, said plurality of switching elements are classified into a first series to n-th series corresponding to a first series to n-th series of said color video signal lines, and said drive pulses to be sequentially outputted from said drive pulse generating circuit are applied to said plurality of switching elements at every series.

3. The active matrix panel according to claim 2, wherein said drive pulse generating circuit comprises a single series of shift register and applies output from respective stages of said shift register to corresponding switching elements as said drive pulses.

4. The active matrix panel according to claim 1, wherein said drive pulse generating circuit comprises a single series of shift register and applies output from respective stages of said shift register to corresponding switching elements as said drive pulses.

5. The active matrix panel according to claim 1, wherein said color video signal lines have an integral number n series;

said drive pulse generating circuit is comprised integral number n series of shift registers and logic gates to which respective outputs from neighboring stages of said shift register are inputted at every series;

said plurality of switching elements are classified corresponding to a first series to a n-th series of said color video signal lines; and output of said logic gates are supplied to corresponding series of said plurality of switching elements.

6. The active matrix panel as described in claim 1, wherein said color video signals comprising a group of R, G, and B signals, said plurality of series of color video signals comprising groups of (1R, 1G, 1B) and (2R, 2G, 2B) signals obtained by dividing respectively said R, G, and B signals into two series, and said drive pulses are applied to a plurality of switching elements belonging to said group of (1R, 1G, 1B) at a first timing and to a plurality of switching elements belonging to said group of (2R, 2G, 2B) at a second timing different from said first timing.

7. A display device comprising:

(i) an active matrix panel, said panel comprising on its substrate:

(a) pixel electrodes and thin film transistors arranged in the form of matrix;

(b) data lines and scanning lines connected with said thin film transistors; and (c) a data line drive circuit for supplying video signals to the data lines, said data line drive circuit comprising:

a plurality of series of color video signal lines for receiving in said panel a plurality of series of input color video signals;

a plurality of switching elements for connecting said plurality of color video signal lines to corresponding data lines; and a drive pulse generating circuit which generates drive pulses for controlling opening and closing of each of said plurality of switching elements at respective prescribed timings, wherein different drive pulses are applied to said plurality of switching elements at every series classified corresponding to a plurality of series of said color video signals, said display device further comprising:

(ii) a single series of sample hold circuit for sampling and holding external color video signals; and (iii) an output line for branching outputs of said single series of sample hold circuit into a plurality of series and outputting them, wherein signals to be output to said output line are supplied at every series to said plurality of series of color video signal lines of said active matrix panel as said plurality of series of color video signals.

8. The display device according to claim 7, wherein said plurality of series of color video signal lines of said active matrix panel are integral number n series, said plurality of switching elements are classified into a first series to n-th series corresponding to a first series to n-th series of said color video signal lines, and said drive pulses to be sequentially outputted from said drive pulse generating circuit are applied to said plurality of switching elements at every series.

9. The display device according to claim 8, wherein said drive pulse generating circuit of said active matrix panel comprises a single series of shift register and applies output from respective stages of said shift register to corresponding switching elements as said drive pulses.

10. The display device according to claim 7, wherein said drive pulse generating circuit of said active matrix panel comprises single series of shift register and applies output at respective stages of said shift register to corresponding switching elements as said drive pulses.

11. The display device according to claim 7, wherein said color video signal lines of said active matrix panel have integral number n series;

said drive pulse generating circuit is comprised integral number n series of shift registers and logic gates to which respective outputs from neighboring stages of the shift registers are inputted at every series;

said plurality of switching elements are classified corresponding to a first series to n-th series of said lines;

and outputs of said logic gates are supplied to corresponding series of said plurality of switching elements.

12. The display device according to claim 7, wherein said device is a display device for displaying analog video signals.

13. A display device comprising:

(i) an active matrix panel, said panel comprising on its substrate:

(a) pixel electrodes and thin film transistors arranged in the form of matrix;

(b) data lines and scanning lines connected with said thin film transistors; and (c) a data line drive circuit for supplying video signals to the data lines, said data line drive circuit comprising:

a plurality of series of color video signal lines for receiving in said panel a plurality of series of input color video signals;

a plurality of switching elements for connecting said plurality of color video signal lines to corresponding data lines; and a drive pulse generating circuit which generates drive pulses for controlling opening and closing of each of said plurality of switching elements at respective predetermined timings, wherein different drive pulses are applied to said plurality of switching elements at every series classified correspondingly to a plurality of series of said color video signals: and (ii) a sample hold circuit for sampling and holding a plurality of series of external color video signals and outputting hold signals at every series at different timing, wherein outputs of said sample hold circuit are supplied at every series to corresponding series of said plurality of series of color video signal lines of said active matrix panel.

14. The display device according to claim 13, wherein said color video signal lines of said active matrix panel have integral number n series;

said plurality of switching elements are classified into a first series to a n-th series corresponding to a first series to n-th series of said color video signal lines;

and said drive pulses to be sequentially outputted from said drive pulse generating circuit are applied to said plurality of switching elements at every series.

15. The display device according to claim 14, wherein said drive pulse generating circuit of said active matrix panel comprises single series of shift register, and supplies outputs from respective stages of said shift register to corresponding switching elements as said drive pulses.

16. The display device according to claim 13, wherein said drive pulse generating circuit of said active matrix panel comprises single series of shift register and supplies outputs at respective stages of said shift register to corresponding switching elements as said drive pulses.

17. The display device according to claim 13, wherein said color video signal lines of said active matrix panel have integral number n series;

said drive pulse generating circuit is comprised integral number n series of shift registers and logic gates to which respective outputs from neighboring stages of the shift registers are inputted at every series;

said plurality of switching elements are classified correspondingly to a first series to a n-th series of said color video signal lines;

and outputs of said logic gates are supplied to corresponding series of said plurality of switching elements.

18. The display device according to claim 13, wherein said device is a display device for displaying graphic video signals.

* * * * *